United States Patent [19]

Gröf et al.

[11] 4,262,159

[45] Apr. 14, 1981

[54] ELECTROSLAG REMELTING APPARATUS WITH COAXIAL CURRENT PATHS

[75] Inventors: Helmut Gröf, Bruchköbel; Otto Stenzel, Gründau; Werner F. Thomas, Hasselroth; Anton Wamser; Uwe Reimpell, both of Hanau am Main, all of Fed. Rep. of Germany

[73] Assignee: Leybold-Heraeus GmbH, Cologne, Fed. Rep. of Germany

[21] Appl. No.: 49,548

[22] Filed: Jun. 18, 1979

[30] Foreign Application Priority Data

Aug. 1, 1978 [DE] Fed. Rep. of Germany ..... 2833695

[51] Int. Cl.[3] ..... H05B 3/60

[52] U.S. Cl. ..... 13/9 ES

[58] Field of Search ..... 13/1, 9 R, 9 ES, 12, 13/13, 14–17

[56] References Cited

U.S. PATENT DOCUMENTS

| | | | |
|---|---|---|---|
| 3,542,932 | 11/1970 | Scheidig | 13/14 |
| 3,684,001 | 8/1972 | Wooding | 13/9 ES |

*Primary Examiner*—Roy N. Envall, Jr.

*Attorney, Agent, or Firm*—Max Fogiel

[57] ABSTRACT

An electroslag remelting arrangement for remelting consumable electrodes into ingots, in which the ingot mold power connection is mounted beneath the mold upper edge on the ingot mold or on the mold floor, and is led away downwardly. The electrode current connection has at least two stationary bus bars which extend continuously from the connection point of the ingot mold to the maximum stroke height of the electrode feed device. The bus bars, moreover, run coaxially or quasi-coaxially with respect to the ingot mold, and are electrically connected to the consumable electrode by sliding contacts and connecting leads.

14 Claims, 5 Drawing Figures

ELECTROSLAG REMELTING APPARATUS WITH COAXIAL CURRENT PATHS

BACKGROUND OF THE INVENTION

The invention relates to an electroslag remelting apparatus for remelting consumable electrodes to form ingots, said apparatus consisting of an ingot mold with a mold floor and a mold current connection, and a vertically movable electrode holder and feed device with an electrode current connection, the current connections being designed at least partly as straight busbars and forming an essentially coaxial or quasi-coaxial conducting arrangement with respect to the consumable electrode and ingot mold.

In electroslag remelting the melting power required to melt the electrode material is generated by the heating effect of the current in the slag bath. When using a single electrode the current flows from the electrode through the slag bath to the ingot. On account of the relatively high resistivity of the molten slag the desired current heating effect is mainly generated by the passage of the current through the slag. Electrical losses in the electrode and ingot are slight compared with the electrical power in the slag bath. Since a current can flow only in a closed electrically conducting circuit, a conducting loop containing the necessary power source must be present outside the electrode-slag-ingot arrangement.

Electroslag remelting is generally carried out with alternating current in order to eliminate the electrolytic effect of direct current. When operating an electroslag remelting apparatus with alternating current it must be ensured that the circuit does not have an inductive effect and that the electromagnetic stray fields are unable to heat the mechanical furnace parts. This effect becomes increasingly troublesome the greater the size of the apparatus since the currents that have to be used for larger ingot cross-sections are correspondingly higher. In order to eliminate this effect as far as possible, large-scale apparatuses are often operated with alternating current whose frequency is substantially below the mains frequency and is for example between 2 and 5 Hz. At such low frequencies the heating effect on the structural parts is very slight and in addition the inductivity of the current loop does not necessitate any additional measures in the largest apparatuses constructed hitherto. The current return conductors can be positioned far from the melting site so that no large currents can arise in the melt region between the current conductors. Such a melt power supply has the disadvantage however that costly frequency converters have to be employed.

To the extent that large ingots and large remelting apparatuses are also operated using mains frequency, the aforementioned conditions must be observed. It is for example absolutely essential to keep the inductivity of the whole furnace arrangement as low as possible since otherwise the bank of capacitors required to compensate for the reactive power (susceptance) would cancel out the cost advantages of the simpler power supply system. If the current return conductor is led very close along one side of the electrode, ingot mold and ingot, the transverse magnetic field due to the return current along the furnace axis is increased compared with the transverse field in an arrangement having a distant return conductor. This magnetic field has a disruptive effect on the electrode on account of the Lorenz force, which is dissipated by the return conductor. There may also be additional volume forces and flows in the slag bath. These physical effects can be avoided by a fully coaxial power supply arrangement, as is already generally known from high frequency techniques. The return conductor must enclose the electrode-slag-ingot arrangement as a tubular conductor. As regards the technical requirements, it is however sufficient to subdivide this tubular conductor into several, radially symmetrically divided individual current conductors. In the limiting case even two radially symmetrically arranged individual current conductors can still be regarded as a quasi-coaxial arrangement. Such an arrangement is sufficient for example to eliminate the disruptive forces acting on the electrode. The effect on the slag bath is also negligibly small with this same arrangement. In this connection there is also the beneficial effect resulting from the fact that the thick-walled ingot mold, which is generally made of copper, provides a lateral shield against the alternating magnetic field.

An electroslag remelting apparatus of the type described at the beginning is known for example from U.S. Pat. No. 3,684,001. In this apparatus the current return conductor is however in the form of a plurality of current ducts, i.e. is led quasi-coaxially, starting from the ingot mold floor via the upper mold edge to a swivellable furnace upper part on which the electrode feed device is mounted by means of an electrode holding rod, which is surrounded by an electrical sliding contact. The bifilar power supply terminates at the upper side of the furnace upper part and then passes into the afore-described coaxial system. In order to enable the furnace upper part to swivel it is necessary to provide releasable electrical couplings in the quasi-coaxial return conductors.

The known arrangement is consequently extremely tall, and its electrode length is roughly 1.5 times greater than that of the subject of the invention described hereinafter since in fact on account of the necessary construction principle the length of the electrode holding rod together with the pressure drive means arranged parallel thereto correspondingly increases the structural height. The arrangement of the return conductors also hinders access to the melt site. Replacement of electrodes is made more difficult and lateral movement of the ingot mold, for example onto a mold carriage, is quite impossible. The use of a sliding mold to produce long ingots in the manner of continuous casting leads to further structural problems, and the alternative use of a lowerable ingot mold floor necessitates additional sliding contacts; above all, replacement of an electrode is made so difficult that, using the known apparatus, it is a complicated and intricate matter to build up an ingot from a plurality of short consumable electrodes which are melted directly one after the other in the same ingot mold using a suitable electrode exchange mechanism. This disadvantage necessitates the use of extremely long consumable electodes, and accordingly the height of the apparatus is further unfortunately increased. The structural height of a remelting apparatus is always governed by the fact that either a correspondingly high remelting hall must be made available, or correspondingly expensive foundation work has to be carried out if the lower part of the remelting apparatus has to be arranged for example in a pit or depression.

The object of the invention is thus to provide an electroslag remelting apparatus of the type described at the beginning whose current paths run substantially coaxially and thus do not result in any interfering losses and damaging heating effects on structural parts, even when using mains frequency, and which at the same time guarantees good accessibility to the melt site for rapid replacement of the electrode and/or ingot mold, and which also has as small a structural height as possible.

SUMMARY OF THE INVENTION

The afore-mentioned object is achieved in accordance with the invention with the afore-described electroslag remelting apparatus by mounting the ingot mould power connection beneath the mold upper edge on the ingot mold or on the mould floor and leading the connection downwardly, and providing the electrode current connection with at least two stationary busbars that extend continuously from the connection point of the ingot mold current connection to the maximum stroke height of the electrode feed device and run coaxially or quasi-coaxially with respect to the ingot mold and are electrically connected to the consumable electrode via sliding contacts and connecting leads.

The mounting of the ingot mold current connection beneath the mold upper edge or preferably on the mold floor, and the fact that this ingot mold current connection, also referred to as a return conductor, leads downwardly means that this ingot mould current connection can be laid completely beneath the hall floor or under the operating platform so that it does not interfere in the operation of the apparatus. The power supply line to the stationary busbars can also be laid at the same place and consequently can also be formed as a bifilar or coaxial arrangement having a particularly low inductivity. Simply the at least two stationary busbars and of course the sliding contacts arranged thereon and the connecting leads to the consumable electrode are located above the hall floor or above the operating platform; flexible power cables, which have to be present there on account of the swivellable furnace upper part in the known apparatus, are not located above the hall floor or operating platform. On account of the continuous construction of the busbars up to the maximum stroke height of the electrode feed device and in connection with their fixed arrangement, it is also not necessary to provide any releasable electrical contacts within the busbars or any drive means required therefor. When using only two quasi-coaxially arranged busbars a rectangular frame is formed in practice which surrounds the ingot mold, the consumable electrode and the electrode feed device, i.e. the so-called melt site, which is consequently extremely accessible from two sides. As will be seen from the following detailed description, an electrode holding rod, whose length corresponds to the overall electrode feed, is not required, which means that the required structural height of the overall apparatus is comparatively lower.

It is naturally particularly advantageous to locate the ingot mold power connection on the mold floor, in particular on the lower side of the mold, and cause the busbars of the electrode power connection to exit upwardly thereform. In this way the melt zone is practically completely shielded from any possible harmful magnetic field effects.

The object of the invention is particularly suitable for an electrode feed device arranged as a vertically drivable side arm on a support column defining the structural height of the apparatus. In this connection, the busbars run continuously substantially over the height of the support column and parallel thereto. A vertically fixed furnace upper part on which again an electrode feed device has to be secured with a suitably long electrode holding rod thus becomes completely superfluous and unnecessary.

The object of the invention can thus be further advantageously implemented by arranging, in a manner known per se, two support columns side-by-side, placing an ingot mould in a E-E-plane of symmetry lying between the support columns and arranging two busbars on both sides of the ingot mould, mounting an electrode feed device on each support column that can be brought into contact via sliding contacts with the same busbars, and providing an electrode support arm on at least one electrode feed device that can be driven vertically in conjunction with the said feed device but can swivel horizontally in an independent manner.

Such an arrangement enables relatively short consumable electrodes to be inserted in sequence and melted to form a single ingot in a particularly simple manner, this procedure also being referred to as alternating technique. While one electrode is still unmelted the laterally swivelled electrode support arm can already be charged with a further consumable electrode, which replaces the preceding electrode once the latter has completely melted. By means of electrical contact devices arranged on the electrode feed devices, details of which will be given in the following detailed description, electrical contact can immediately be made starting from the busbars once the relevant consumable electrode has been swung in, and without the need for long flexible power supply lines. Moreover, a so-called heavy-current switch can be completely omitted since the electrical contact device between the sliding contacts and the consumable electrode can in addition undertake this function.

Further advantageous embodiments of the object of the invention constitute the subject matter of the remaining subclaims, and the resulting advantages will be dealt with more fully in the detailed description.

BRIEF DESCRIPTION OF THE DRAWINGS

Embodiments of the object of the invention are described in more detail hereinafter and with the aid of FIGS. 1 to 5, in which.

DESCRIPTION OF THE PREFERRED EMBODIMENTS

Figure 1:
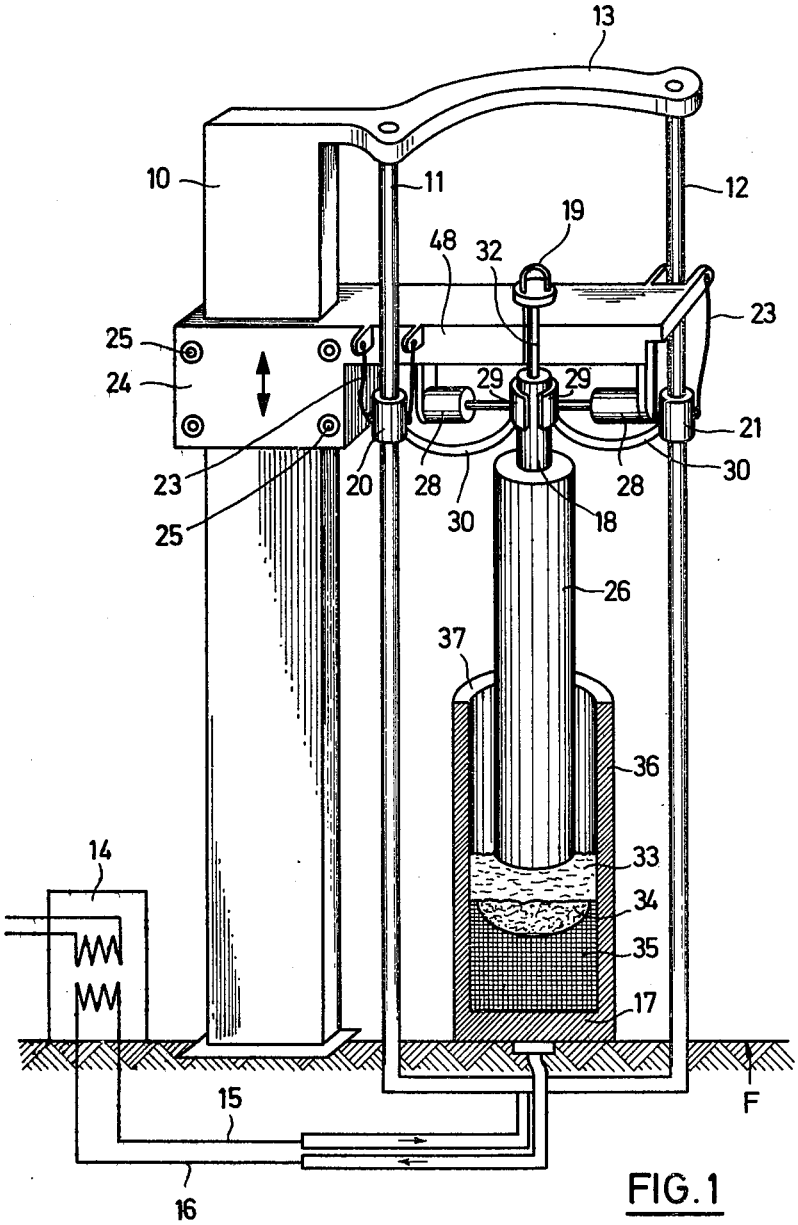
FIG. 1 is a perspective view of an electroslag remelting apparatus with a fixed ingot mold shown cut away.

In FIG. 1, busbars 11 and 12 are held parallel with respect to a support column 10 by means of a transverse carrying member 13. The support column 10 as well as the busbars 11 and 12 are mounted in a foundation F, on which an electrical power supply device 14 also stands. From the latter a current conductor 15 runs within the foundation F to the two busbars 11 and 12, and an ingot mold current connection 16 runs to the mold floor 17. The current conductor 15 and ingot mold current connection 16 are arranged closely adjacent to one another, but may also be arranged coaxially. The current conductor 15 branches underneath the ingot mold floor 17 and is there connected to the busbars 11 and 12, which are formed as pipes through which cooling water is passed. Sliding contacts 20 and 21 are arranged on the busbars 11 and 12, and are suspended from an electrode feed device 24 by means of vertical linkages 23, the feed device 24 itself being arranged in a vertically movable manner on the support column 10 via castors 25. A consumable electrode 26 is suspended from the electrode feed device 24. In addition, two diametrically oppositely positioned pneumatic cylinders 28 are arranged on the electrode feed device 24, by means of which the contact members 29 can be pressed against a clamping head 18 welded to the consumable electrode 26. The contact members 29 are connected via flexible connecting leads 30 to the sliding contacts 20/21 so that the contact members 29 can move relative to the sliding contacts. The clamping head 18 is inserted in a slit 32 in the electrode feed device 24 (looking in a direction from the observer), and passes between the contact members 29. The consumable electrode is suspended by means of a crane and a supporting eyelet 19 secured to the clamping head 18. For the purposes of suspending the consumable electrode, the transverse carrying member 13 is curved sufficiently wide.

In the remelting process a circuit is formed which runs from the power supply device 14 via the current conductor 15, the diametrically opposite, parallel busbars 11 and 12, the sliding contacts 20 and 21, the connecting leads 30, the contact members 29, and the clamping head 18, to the consumable electrode 26. From here the current path passes through a bath of molten slag 33, in which the lower end of the consumable electrode 26 is immersed, to a bath of molten metal 34 and through an ingot 35, in the course of synthesis, via the ingot mold floor 17 and the ingot mold current connection 16 back to the power supply device 14. The lower electrode part, the slag 33, bath of molten metal 34 and ingot 35 are thus surrounded by a liquid-cooled ingot mold 36 having an ingot mold upper edge 37. It can be seen that the current paths in the region of the busbars 11 and 12 and consumable electrode 26 run coaxially within the meaning of the above definition, whereupon the afore-mentioned effects occur. The busbars 11 and 12 form, together with the transverse carrying member 13, a type of portal or bridge in which the electrode feed device 24 moves vertically. The melting site defined by the ingot mold 36 is thus readily accessible from both sides and accordingly there are no obstacles to replacing the consumable electrode 26 and also the ingot mold 36. With the exception of the very short connecting leads 30, there are no flexible leads whatsoever in the upper region of the electroslag remelting apparatus. The apparatus is thus planned and constructed in a simple and rational manner, and any repairs that may be necessary can easily be effected.

Figure 2:
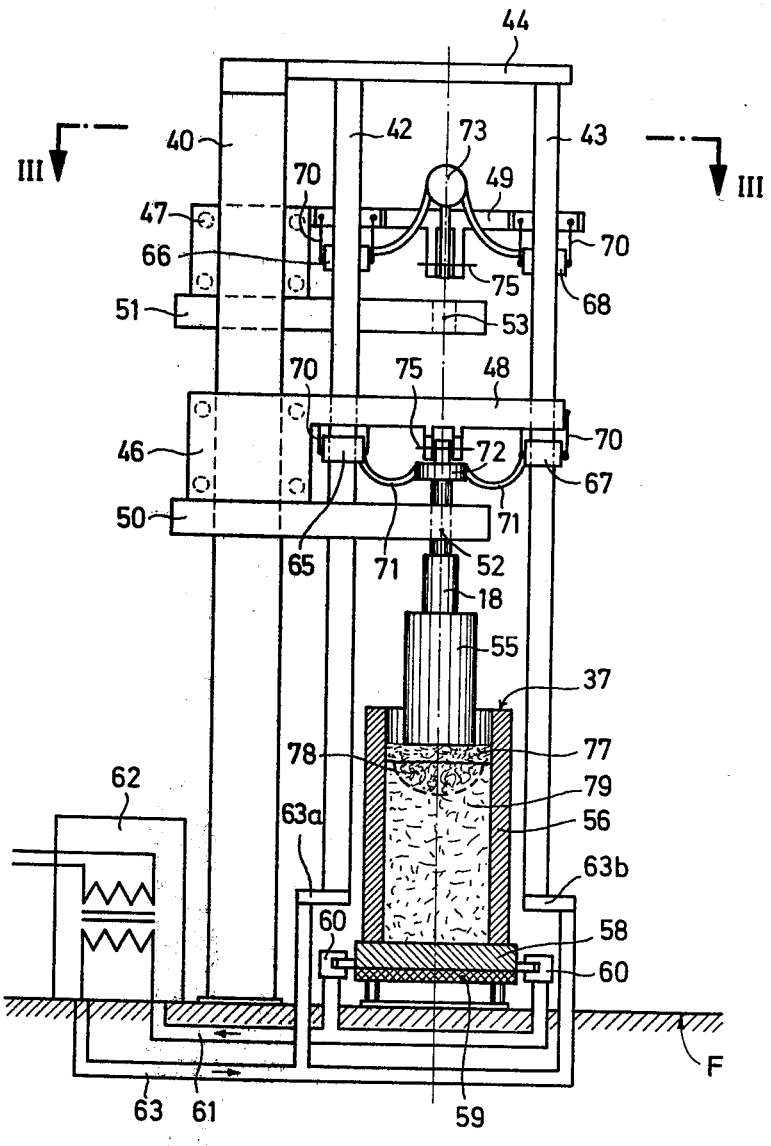
FIG. 2 is a side view of an electroslag remelting apparatus having two support columns and two electrode feed devices, as well as a fixed ingot mold arranged on an ingot carriage.
Figure 3:
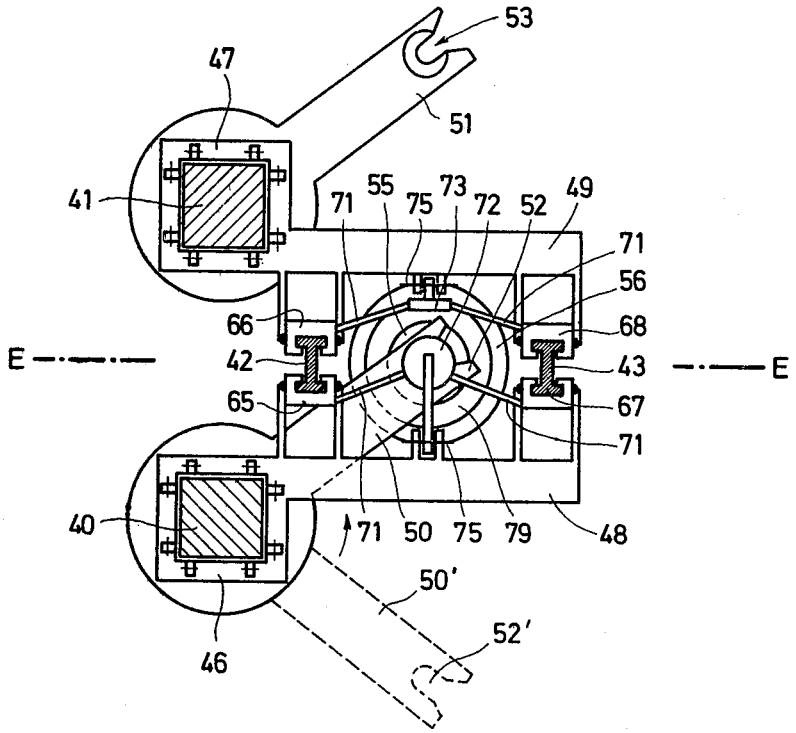
FIG. 3 is a section along the line III—III through the object of FIG. 2.

The electroslag remelting apparatus according to FIGS. 2 and 3 has two fixed support columns 40 and 41, as well as two likewise fixed busbars 42 and 43, connected to one another via a transverse carrying member 44 and to the support columns, in which connection appropriate insulation must of course be provided. The busbars 42 and 43 lie with their longitudinal axes in a plane of symmetry E-E between the two support columns. Two vertically drivable electrode feed devices 46 and 47 with brackets 48 and 49 are arranged on the two support columns 40 and 41 by means of rollers, not described in more detail, sliding contacts 65, 66, 67 and 68, engaging with the busbars 42 and 43, being located on said brackets 48 and 49. The sliding contacts 65 and 67 are associated with the bracket 48, and the sliding contacts 66 and 68 with the bracket 49. The busbars are formed as a I-shaped profile in the present case, only the flanges of the profile being surrounded by the sliding contacts. The special design and arrangement of the busbars as well as the sliding contacts according to FIG. 3 ensures that two sliding contacts can be moved independently on each busbar and without hindering one another.

The sliding contacts 65 to 68 are suspended via vertical linkages 70 on the brackets 48 and 49 so that they can be moved together therewith. Power is transferred from the sliding contacts 65 to 68 via flexible connecting leads 71 to contact plates 72 and 73, which are swivellably connected to the brackets 48 and 49 respectively. The two different end positions of the contact plates are shown in FIGS. 2 and 3. The swivelling movement of the contact plates about the horizontal swivel axes 75 is effected by drive means, not shown. ,p Electrode support arms 50 and 51 are arranged on the electrode feed devices 46 and 47, and can be driven vertically together with the electrode feed devices 46 and 47 but can be swivelled horizontally independently of one another. Two possible end positions of these electrode support arms 50 and 51 are shown in FIG. 3. The said support arms have fork-shaped recesses 52 and 53 at their ends in which the electrodes 55 can be suspended by means of the clamping heads 18. In FIG. 3 the electrode support arm 50 together with the electrode 55 is shown in the melt position, i.e. the electrode 55 projects concentrically into an ingot mold 56 standing on an ingot mold floor 58, which in turn is arranged on a mold carriage 59. The ingot mold floor 58 is connected via clamping contacts 60 to an ingot mold current connection 61, leading to a power supply device 62.

A further current conductor 63 leads, likewise within the foundation F and with branching into leads **63*a* and 63*b*, to the busbars 42 and 43**.

The apparatus according to FIGS. 2 and 3 operates as follows: the electrode support arm 50 is initially in the position 50' shown by the dotted line in FIG. 3. The electrode 55 is then suspended in the recess 52= and swung, together with the electrode support arm, to the illustrated position above the ingot mold 56. The upper horizontal surface of the clamping head 18 thus arrives at such a position that the contact plate 72, after the downward swivelling movement to the horizontal position, touches and makes good electrical contact with the said surface. The electrode feed device 46 together with the bracket 48, electrode support arm 50, contact plate 72 and sliding contacts 65 and 67 is then moved downwardly until the consumable electrode 55 dips into the molten layer of slag 77 above the bath of molten metal 78 and remelted ingot 79. The circuit thereby completed runs from the power supply device 62 via the current conductor 63, the two leads 63*a* and 63*b*, busbars 42 and 43, to the sliding contacts 65 and 67 and thence via the connecting leads 71 and contact plates 72 to the clamping head 18 and consumable electrode 55. From the consumable electrode 55 the current path runs through the slag layer 77, bath of molten metal 78, ingot 79, ingot mold floor 58, clamping contacts 60 and ingot mold current connection 61 back to the power supply device 62.

During the melt process a further consumable electrode is already inserted in the other electrode support arm 51 and held there in readiness. As soon as the electrode 55 in the electrode support arm 50 has melted, the electrode feed device 46 moves upwardly and the contact plate 77 is swung away upwardly around the swivel axis 75. The electrode support arm 50 is swung back again to the position 50' shown by the dotted lines, and thereby frees the space above the ingot mold 56 so that the electrode support arm 51 can be swung to a position in which the new consumable electrode is positioned above the ingot mold 56. When the contact plate 73 is swung away about the swivel axis 75, the new electrode is connected via the connecting leads 71 to the sliding contacts 66 and 68. On lowering the electrode feed device 47 the new electrode is introduced into the molten layer of slag 77 and the remelting process is continued. The remainder of the consumable electrode 45 can now be removed from the electrode support arm 50' and the latter can be loaded with a further consumable electrode and the whole procedure repeated.

A contact can be mounted on each electrode support arm 50, 51 in order to connect the consumable electrode to the sliding contacts 65/67 and 66/68, part of the electrical connection being on the electrode support arm 50, 51, and the other part being on the electrode feed device 46, 47. Both parts can then be coupled in a known manner in the melt position of the electrodes above the ingot mold by means of contacts provided with drive means.

Figure 4:
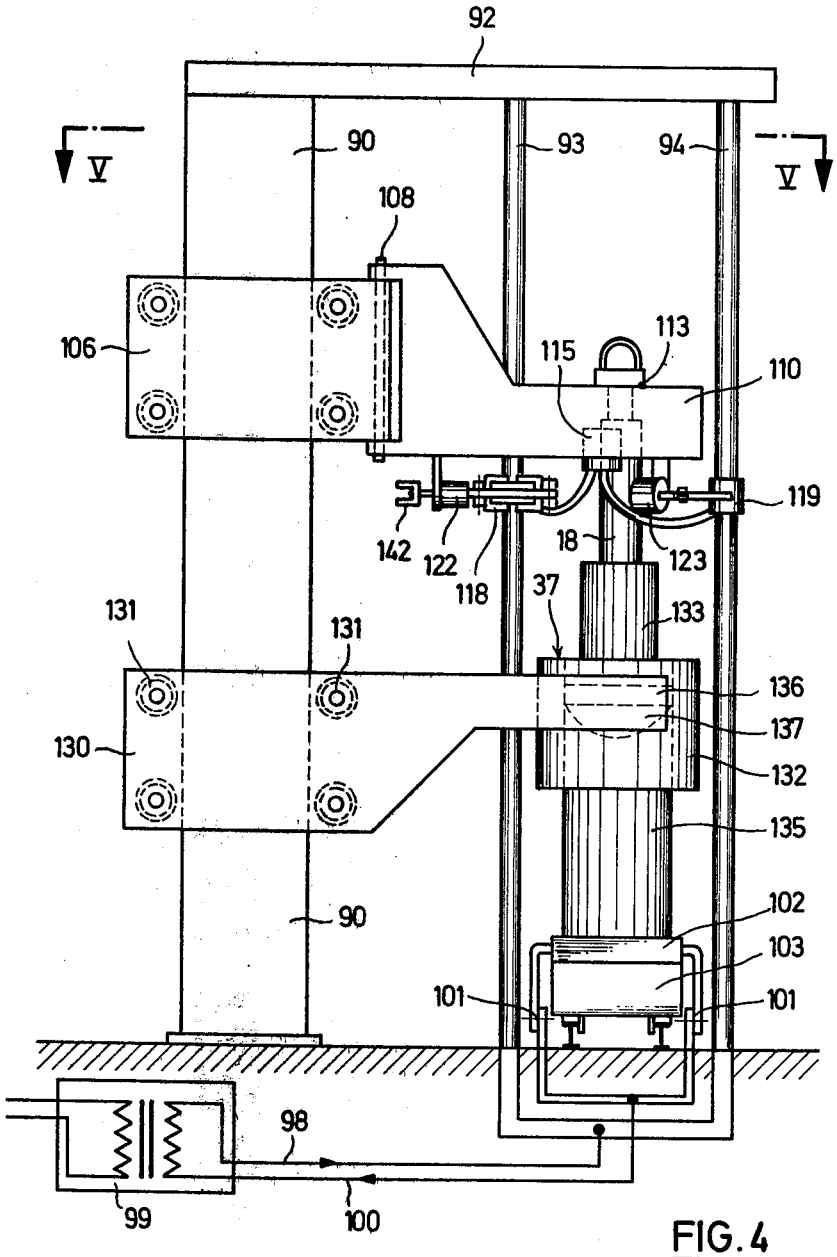
FIG. 4 is a side view of an electroslag remelting apparatus with two support columns and two electrode feed devices having swivellable electrode support arms, and with a sliding ingot mold and a fixed ingot mold, the sliding ingot mold being arranged at the point of intersection of the radii of swivel of the two electrode support arms.
Figure 5:
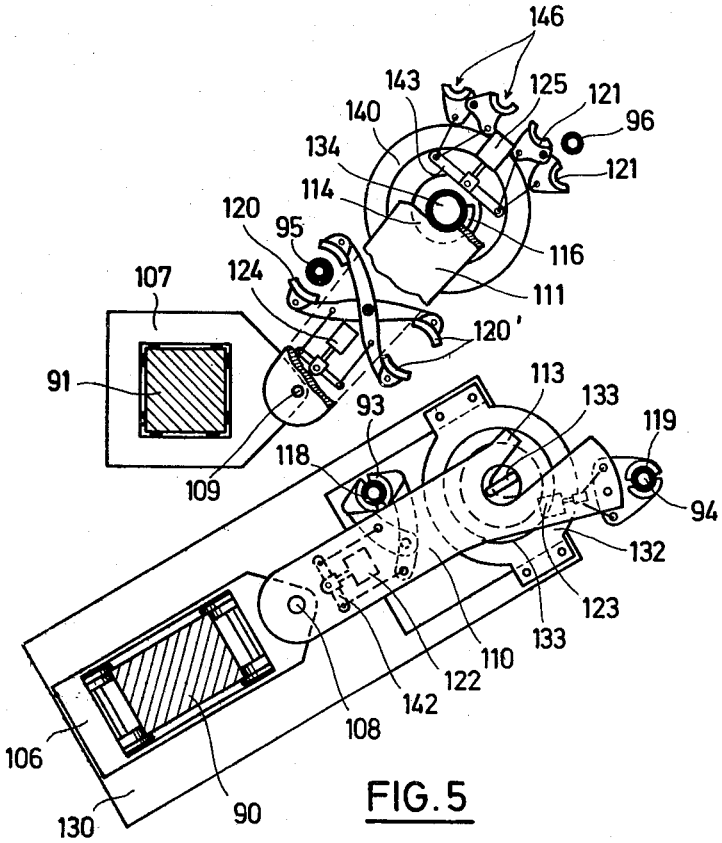
FIG. 5 is a section through the object of FIG. 4, along the line V—V.

The electroslag remelting apparatus according to FIGS. 4 and 5 also has two support columns 90 and 91 connected by a common plate 92, which also holds the busbars 93, 94, 95 and 96 at the top. These busbars are mounted in a fixed manner at the bottom and run parallel to one another and to the support columns 90 and 91. The busbars 93 and 94 are connected via a current conductor 98 to a power supply device 99. An ingot mold current connection 100 leads from the power supply device 99 via two clamping contacts 101 to the ingot mold floor 102, which latter is arranged on the ingot mold carriage 103. The power supply device, the disposition of the current conductors to the busbars 95 and 96 and the disposition of the associated ingot mold current connection is similar to the circuit arrangement shown in FIG. 4. The special arrangement of the busbars 93/94 on the one hand, and 95/96 on the other hand according to FIG. 5 will be referred to in more detail hereinafter.

Electrode feed devices 106 and 107 are arranged in a vertically drivable manner on the support columns 90 and 91, as in the previous embodiments, electrode support arms 110 and 111 being mounted in a horizontally swivellable manner on the said electrode feed devices 106 and 107 by means of swivel bearings 108 and 109. Clamping heads 113 and 114 as well as contacts 115 and 116 for the consumable electrodes 133 and 134 are located on said arms 110 and 111. Sliding contacts 118, 119, 120 and 121 are also provided, which are formed as contact pincers in the present case, i.e. are subdivided in the circumferential direction so that they can be opened and removed from the busbars. Actuating cylinders 122, 123, 124 and 125 are also associated with pincer-shaped sliding contacts.

The support column 90 is rectangular and has a greater cross-section than the support column 91. The longitudinal axis of the cross-section of the support column 90 also runs inclined with respect to the support column 91, for the following reason: on the support column 90 there is, in addition to the electrode feed device 106, an ingot mold feed device 130 that can be driven vertically on the support column 90 by means of wheels 131. The ingot mold feed device carries an ingot mold 132 formed as a sliding mold, in which an ingot 135 standing on the ingot mold floor 102 is melted as the ingot mould is continuously raised.

By virtue of the spatial arrangement or positioning of the support columns 90 and 91, the swivel bearings 108 and 109, the length of the electrode support arms 110 and 111 from the swivel bearings to the clamping heads 113 and 114, and also by virtue of the clearance of the mid axis of the ingot mold 132 with respect to the support column 90, the point of intersection of the radii of swivel of the two electrode support arms 110 and 111 can be made to coincide with the mid axis of the ingot mold 132. In this way it is possible to melt alternately consumable electrodes 133 and 134 in the same ingot mold 132 using both electrode support arms 110 and 111, a procedure similar to that described in connection with FIGS. 2 and 3.

As can be seen from FIGS. 4 and 5, the two busbars 93 and 94 are arranged symmetrically or quasi-coaxially with respect to the ingot mold 132, electrode 133, slag melt 136, bath of molten metal 137 and ingot 135. The busbars 93 and 94 also lie in a plane of symmetry running between the support columns 90 and 91, to be more precise between the swivel bearings 108 and 109, and in which the mid axis of the ingot mold 132 also lies. The sliding contacts 118 and 119 of the electrode support arm 110 are connected to the busbars 93 and 94 in a position according to FIGS. 4 and 5, and thus the circuit is closed in the afore-described manner.

When the electrode support arm 110 has been swung out, for example when the electrode 133 has been consumed, the electrode support arm 111 can be swung around the swivel bearing 109 until the consumable electrode 134 is aligned concentrically with respect to the ingot mold 132. In such a case a sliding contact 120', which is located opposite the sliding contact 120 but is part of the same contact pincers, can be brought into engagement with the busbar 93. A sliding contact 146 is located on the front face of the electrode support arm 111, and is likewise formed as contact pincers. When the electrode support arm 111 has been swivelled, the sliding contact 146 engages with the busbar 94. The melt process for the consumable electrode 134 can now be carried out in the same ingot mold 132 by means of the electrode feed device 107.

Whereas in FIG. 4 only the support column 90 with its associated device parts has been shown for the sake of clarity, FIG. 5 shows in addition in section and in plan view all the essential details of the device parts of the support column 91. A further ingot mould 140 as well as the two busbars 95 and 96 arranged symmetrically or quasi-coaxially to the ingot mold 140 are associated with the said support column 91. The ingot mold 140 can be charged only by means of the electrode support arm 111. It can however also be charged in addition to or independently of the ingot mold 132 for the parallel synthesis of an ingot. In the melting operation in the ingot mold 140 the sliding contact 120 is closed around the busbar 95 and the sliding contact 121 is closed around the busbar 96. It is possible to coordinate in a similar manner an additional stationary ingot mold with the electrode support arm 110, which cannot be charged by means of the electrode support arm 111. Busbars would then likewise be associated in a quasi-coaxial arrangement and in a similar manner with such an ingot mold.

With regard to the sliding contacts 118 to 121, and 146, which are formed as contact pincers, it should also be pointed out that they are swivellably mounted and can adapt to very small movements of the busbars 93 to 96. The actuating cylinder 122 of the slide contact 118 acts via a lever 142 and two tie rods, not described here in more detail, on the sliding contact 118 and opens/-closes the latter. In this connection, the opening width is sufficiently large so that when the electrode support arm 110 swivels there is no longer any further contact with the busbar 93. The sliding contact 119 is opened and closed in a similar manner by means of the actuating cylinder 123. This is arranged in a swivellable manner, the sliding contact being able to adapt, when closed, to the spatial position of the busbar 94. When the sliding contact 119 is open the individual contact jaws are swung back until they do not touch the busbar 94 when the electrode support arm 110 is swung horizontally. The sliding contact 121 has such an opening position, and can be opened and closed by means of the actuating cylinder 125, and a transmission lever 143 with rods, not described here in more detail. The sliding contacts 121 and 146 form a so-called double pincers, the sliding contact 121 being able to be brought into contact with the busbar 96 and the sliding contact 146 into contact with the busbar 94, depending on the position of the electrode support arm 111. The sliding contacts 120 and 120' are formed in a similar manner as a double pincers, and co-operate with the busbars 95 and 96.

The operation of the electroslag remelting apparatus according to FIGS. 4 and 5 is as follows: when the electrode feed devices 106 and 107 have been moved upwardly to appropriately high positions, the consumable electrodes 133 and 134 are suspended in the clamping heads 113 and 114. The contacts 115 and 116 are pressed mechanically against the electrodes, and the electrode support arm 110 is brought over the ingot mold 132, while the electrode support arm 111 is moved over the ingot mold 140. In order to replace the electrode in the ingot mold 132 the electrode support arm 111 can also be moved over the ingot mold 132, as has already been discussed above. In the positions shown in FIG. 5 the actuating cylinders 122 to 125 for the sliding contacts 118 to 121 are switched on and close the sliding contacts so that the latter engage on the busbars 93 to 96. Quasi-coaxial current paths are thus produced in both cases, as has already been illustrated for part of the apparatus with the aid of FIG. 4: the current flows from the power supply device 99 via the current conductor 98 to the busbars 93 and 94, sliding contacts 118 and 119, flexible connecting leads (not described in more detail) and to the contacts 115 and 116 for the consumable electrode 133. The current then flows to the slag melt 136 in the ingot mold 132 and through the path of molten metal 137, ingot 135, ingot mold floor 102, clamping contacts 101 and ingot mold current connection 100, back to the power supply device 99. In this case too care has been taken to ensure that coaxiality or quasi-coaxiality exists over the essential section of all current paths. Nevertheless, the overall apparatus has a minimum structural height while at the same time providing good accessibility to the melt site or sites.

We claim:

1. An electroslag remelting apparatus for remelting consumable electrodes into ingots, comprising: an ingot mold with a mold floor and a mold current connection, and a vertically movable electrode holder and feed device with an electrode current connection, current connections being at least partly straight busbars and forming a substantially coaxial conducting arrangement with respect to the consumable electrode and ingot mold, the ingot mold power connection being mounted beneath the mold upper edge on the ingot mold and being led away downwardly, the electrode current connection having at least two stationary busbars extending continuously from the connection point of the ingot mold current connection to the maximum stroke height of the electrode feed device and running substantially coaxially with respect to the ingot mold and being electrically connected to the consumable electrode via sliding contacts and connecting leads.

2. An electroslag remelting apparatus according to claim 1, wherein the ingot mold current connection is mounted on the ingot mold floor and the busbars of the electrode current connection extend upwardly from underneath the ingot mold floor.

3. An electroslag remelting apparatus according to including a support column; said electrode feed device being arranged in a vertically drivable manner on said support column, said support column determining the structural height of the apparatus, said busbars being arranged in a continuous manner over substantially the whole height of the support column and parallel thereto.

4. An electroslag remelting apparatus according to claim 3, including a transverse carrying member connecting said support column and busbars at their upper ends.

5. An electroslag remelting apparatus according to claim 4, wherein said transverse carrying member is curved laterally in the region above the consumable electrode.

6. An electroslag remelting apparatus according to claim 1, including vertical linkages for suspending said sliding contacts on said electrode feed device.

7. An electroslag remelting apparatus according to claim 1, including two support columns arranged side-by-side, an ingot mold lying in a plane of symmetry between said support columns, two busbars being arranged on both sides of the ingot mold, an electrode feed device for the consumable electrodes being arranged on each support column and contacting busbars by said sliding contacts; an electrode support arm being arranged on at least one electrode feed device and being drivable vertically in conjunction therewith said electrode support arm being independently swivable horizontally.

8. An electroslag remelting apparatus according to claim 7, wherein the consumable electrode is connectable to the busbars by said sliding contacts; said sliding contacts being movable on said busbars independently of the swivel position of the electrode support arms, and movable contact plates for forming electrical connection at a concentric position of the consumable electrode with respect to the ingot mold.

9. An electroslag remelting apparatus according to claim 7, wherein an ingot mold feed device is arranged on one of the two support columns an ingot mold being located at a point of intersection of radii of swivel of both electrode support arms; sliding contacts formed as contact pincers being located on the electrode support arms, said sliding contacts being connectable to the consumable electrodes and being engageable with the symmetrically arranged busbars.

10. An electroslag remelting apparatus according to claim 9, wherein at least one further ingot mold with coaxially arranged busbars is present outside said ingot mold arranged symmetrically with respect to said two support columns, one of the two electrode support arms and associated contact pincers being movable into cooperation with said busbars.

11. An electroslag remelting apparatus according to claim 1, wherein the ingot mold floor can be driven on an ingot mold carriage and is connected by clamping contacts to the ingot mold current connection.

12. An electroslag remelting apparatus according to claim 1, wherein the ingot mold current connection has clamping contacts for permitting the position of the ingot mold floor to be changed with respect to the consumable electrode.

13. Apparatus as defined in claim 1, wherein said ingot mold power connection is mounted on the molded floor.

14. Apparatus as defined in claim 1, wherein said ingot mold current connection is mounted on the ingot mold floor and the busbars of the electrode current connection extend upwardly from underneath the ingot mold floor; a support column, said electrode feed device being arranged in a vertically drivable manner on said support column, said support column determining the structural height of the apparatus, said busbars being arranged in a continuous manner over substantially the whole height of the support column and parallel thereto; a transverse carrying member connecting said support column and busbars at their upper ends, said transverse carrying member being curved laterally in the region above the consumable electrode; vertical linkages for suspending said sliding contacts on said electrode feed device; said ingot mold carriage, said ingot mold floor being drivable on said ingot mold carriage and being connected by clamping contacts to the ingot mold current connection, said clamping contacts permitting the position of the ingot mold floor to be changed with respect to the consumable electrode.

* * * * *